US008141230B2

(12) United States Patent
Brodt et al.

(10) Patent No.: US 8,141,230 B2
(45) Date of Patent: Mar. 27, 2012

(54) PRESS-HARDENED COMPONENT AND PROCESS FOR PRODUCING A PRESS-HARDENED COMPONENT

(75) Inventors: Martin Brodt, Weil der Stadt (DE); Roland Wendler, Boeblingen (DE); Leonid Levinski, Brussels (BE); Victor Samoilov, Moscow (RU)

(73) Assignee: Z.A.T. Zinc Anticorosion Technologies SA, Fribourg (CH)

( * ) Notice: Subject to any disclaimer, the term of this patent is extended or adjusted under 35 U.S.C. 154(b) by 0 days.

(21) Appl. No.: 10/565,229

(22) PCT Filed: May 29, 2004

(86) PCT No.: PCT/EP2004/005855

§ 371 (c)(1),
(2), (4) Date: Jan. 20, 2006

(87) PCT Pub. No.: WO2005/018848

PCT Pub. Date: Mar. 3, 2005

(65) Prior Publication Data

US 2006/0219334 A1 Oct. 5, 2006

(30) Foreign Application Priority Data

Jul. 22, 2003 (DE) ..... 103 33 165

(51) Int. Cl.
*B23P 17/00* (2006.01)
*B23P 25/00* (2006.01)

(52) U.S. Cl. ..... 29/527.2; 29/527.4; 29/897.2; 29/557; 29/DIG. 49; 148/654; 148/647; 148/649

(58) Field of Classification Search ..... 29/527.2, 29/527.4, 557, 897.2, DIG. 49; 148/516, 148/537, 579, 654, 647, 649; 72/379.2
See application file for complete search history.

(56) References Cited

U.S. PATENT DOCUMENTS

| | | | | | |
|---|---|---|---|---|---|
| 1,552,059 | A | * | 9/1925 | Kirk | 432/155 |
| 1,850,576 | A | * | 3/1932 | Zimmerman | 209/238 |
| 1,920,678 | A | * | 8/1933 | Cowper-Coles | 427/190 |
| 2,707,629 | A | * | 5/1955 | Kennedy | 432/10 |
| 2,748,037 | A | * | 5/1956 | Burnham | 148/256 |
| 2,814,578 | A | * | 11/1957 | White | 148/530 |
| 3,133,829 | A | * | 5/1964 | Cupery et al. | 427/379 |
| 3,297,469 | A | * | 1/1967 | Otis et al. | 427/318 |
| 3,558,460 | A | * | 1/1971 | Uchida et al. | 205/142 |
| 4,238,532 | A | * | 12/1980 | Dreulle | 427/309 |
| 4,730,870 | A | * | 3/1988 | DeRees | 296/193.04 |
| 4,973,368 | A | * | 11/1990 | Lund | 148/570 |
| 5,089,551 | A | * | 2/1992 | Hegedus et al. | 524/396 |

(Continued)

FOREIGN PATENT DOCUMENTS

DE 100 49 660 4/2002

(Continued)

*Primary Examiner* — Essama Omgba
(74) *Attorney, Agent, or Firm* — Norman B. Thot

(57) ABSTRACT

A press-hardened component and a method for producing press-hardened components, in particular a bodywork component, from a semi-finished product made from unhardened, hot-formable steel sheet. Various process steps are carried out in the process. A component blank is formed from the semi-finished product by a cold-forming process, in particular a drawing process. The component blank is trimmed at the margin side to a margin contour which approximately corresponds to the component to be produced. The trimmed component blank is heated and press-hardened in a hot-forming tool, and then the press-hardened component blank is covered with a corrosion-prevention layer in a coating step.

23 Claims, 4 Drawing Sheets

U.S. PATENT DOCUMENTS

| | | | | |
|---|---|---|---|---|
| 5,100,942 | A * | 3/1992 | Hegedus et al. | 524/204 |
| 5,494,706 | A * | 2/1996 | Abe et al. | 427/329 |
| 5,516,586 | A * | 5/1996 | Singer et al. | 428/433 |
| 5,616,189 | A * | 4/1997 | Jin et al. | 148/549 |
| 5,626,694 | A * | 5/1997 | Kawabata et al. | 148/609 |
| 5,728,241 | A * | 3/1998 | Gupta et al. | 148/694 |
| 5,756,221 | A * | 5/1998 | Horibe et al. | 428/626 |
| 6,171,359 | B1 * | 1/2001 | Levinski et al. | 75/252 |
| 6,176,948 | B1 * | 1/2001 | Lund et al. | 148/654 |
| 6,294,031 | B1 * | 9/2001 | Takeno et al. | 148/654 |
| 6,564,604 | B2 * | 5/2003 | Kefferstein et al. | 72/47 |
| 6,584,671 | B2 * | 7/2003 | Miller et al. | 29/596 |
| 6,645,322 | B2 * | 11/2003 | Wang | 148/537 |
| 6,802,912 | B2 * | 10/2004 | Bogar et al. | 148/23 |
| 6,878,220 | B2 | 4/2005 | Gehringhoff et al. | 148/654 |
| 6,953,509 | B2 * | 10/2005 | Keener | 148/537 |
| 7,041,181 | B2 * | 5/2006 | Gosmann | 148/537 |
| 7,077,920 | B2 * | 7/2006 | Gehringhoff | 148/530 |
| 7,115,322 | B2 * | 10/2006 | Curtiss et al. | 428/582 |
| 7,128,949 | B2 * | 10/2006 | Keener et al. | 427/385.5 |
| 7,137,201 | B2 * | 11/2006 | Brodt et al. | 29/897.2 |
| 7,192,624 | B2 * | 3/2007 | Shtikan et al. | 427/251 |
| 7,241,350 | B2 * | 7/2007 | Rosenthul | 148/533 |
| 7,387,694 | B2 * | 6/2008 | Siebenlist et al. | 148/579 |
| 7,422,652 | B2 * | 9/2008 | Ondrus et al. | 156/322 |
| 7,475,478 | B2 * | 1/2009 | McCrink et al. | 29/897.2 |
| 2002/0069506 | A1 | 6/2002 | Brodt et al. | 29/505 |
| 2002/0174920 | A1 * | 11/2002 | Gupta et al. | 148/537 |
| 2004/0163740 | A1 * | 8/2004 | Keener et al. | 148/537 |
| 2004/0261920 | A1 * | 12/2004 | Kami et al. | 148/652 |
| 2005/0109433 | A1 * | 5/2005 | Danger et al. | 148/533 |
| 2007/0000117 | A1 * | 1/2007 | Brandstatter et al. | 29/527.2 |
| 2007/0256808 | A1 * | 11/2007 | Fleischanderl et al. | 164/72 |
| 2007/0271978 | A1 * | 11/2007 | Brandstatter et al. | 72/47 |

FOREIGN PATENT DOCUMENTS

| | | | | |
|---|---|---|---|---|
| DE | 101 49 221 | C1 | | 8/2002 |
| DE | 10224319 | A1 | * | 12/2003 |
| DE | 102 54 695 | B3 | | 4/2004 |
| DE | 10246614 | A1 | * | 4/2004 |
| EP | 1 195 208 | A2 | | 4/2002 |
| WO | WO 2005009642 | A1 | * | 2/2005 |

* cited by examiner

PRESS-HARDENED COMPONENT AND PROCESS FOR PRODUCING A PRESS-HARDENED COMPONENT

The invention relates to a press-hardened component and a process for producing a press-hardened component.

BACKGROUND

High rigidity and strength requirements are imposed on bodywork components used in automobile construction. At the same time, however, a reduction in the material thickness is desirable with a view to minimizing weight. High-strength and ultrahigh-strength steel materials, which allow the production of components with very high strength combined, at the same time, with a low material thickness, offer a solution to these inherently contradictory requirements. Strength and toughness properties of a component can be set in a targeted way by suitable selection of process parameters during hot-forming which is customarily used for these materials.

To produce a component of this type with the aid of hot-forming, first of all a plate is cut from a coil, and this plate is then heated to above the microstructure transformation temperature of the steel material above which the material is in the austenitic state, is placed into a forming tool in the heated state and deformed to the desired component shape before being cooled, so as to mechanically fix the desired deformed state, with the component being treated and/or hardened.

Often, the component is subjected to a pre-forming step or a trimming step prior to the actual hot-forming. This is described for example in DE 101 49 221 C1. However, a process of this type can cause problems with regard to corrosion, since a strip coating which is customarily applied is damaged during the pre-forming. Standard pre-forming and trimming of the components is not possible in particular in the case of pre-coated high-strength steels such as Usibor 1500 PC, which has an AlSi coating, since the pre-coating is too brittle and consequently the protection against corrosion would be lost.

SUMMARY OF THE INVENTION

It is an object of the invention to provide a press-hardened component and a process for producing press-hardened components which allow reliable protection against corrosion and at the same time are suitable for series production.

A first embodiment of the process according to the invention for producing press-hardened components comprises the following process steps: a component blank is formed from the semi-finished product by a cold-forming process, in particular a drawing process; the component blank is trimmed at the margin side to a mar gin contour which approximately corresponds to the component to be produced; the trimmed component blank is heated and press-hardened in a hot-forming tool; the press-hardened component blank is covered with a corrosion-prevention layer in a coating step.

This configuration of the invention on the one hand enables the component production process to be implemented in such a way that it is possible to dispense with the final trimming of the hardened component, which represents a complex and expensive process operation. The margin regions are therefore cut to size while the component is still in the unhardened state, rather than only after the heating and hardening process, as has hitherto been customary when using hot-forming. On account of the workpiece being trimmed while it is still in the soft state, the cutting forces required are significantly lower than those needed for the cold-cutting of hardened materials, which leads to reduced tool wear and to a reduction in the maintenance costs for the cutting tools. Furthermore, trimming the high-strength material while it is in the unhardened state considerably reduces the risk of rapid formation of cracks on account of the high notch sensitivity of these materials.

A corrosion-prevention layer is only applied after the hardening process, with the result that the component is completely coated, i.e. even at the margins.

In another embodiment of the process according to the invention for producing press-hardened components, the following process steps are carried out: the semi-finished product is heated and press-hardened in a hot-forming tool; the component blank produced in this way is trimmed at the margin side to a margin contour which corresponds to the component to be produced; the press-hardened, trimmed component blank is covered with a corrosion-prevention layer in a coating step.

In this embodiment, the trimming of the hardened component is preferably carried out with the aid of a laser cutting process or the water jet cutting process, by means of which high-quality trimming of the component edges can be achieved. The subsequent application of a corrosion-prevention layer ensures that the component is protected from corrosion even in the region of the trimmed margins.

If the layer is applied to the press-hardened component blank using a hot-dip galvanization process, it is possible for a zinc corrosion-prevention layer to be applied in a coating process which can be suitably integrated in a manufacturing process.

If the layer is applied to the press-hardened component blank by a thermal diffusion process, it is possible to use a controllable process by which preferably a layer of zinc or a zinc alloy which is suitable even for complex component geometries and for edge coating can be applied. The layer thickness can be deliberately set between a few μm and over 100 μm. There is little thermal stressing of the component. It is possible to coat components irrespective of their size, dimensions, configuration, complexity and weight.

Cleaning the press-hardened component blank by dry cleaning prior to the coating step improves the bonding of the layer. Scaling at the surface caused by the hot-forming is eliminated. There is no need for preliminary chemical cleaning.

It is expedient for the press-hardened component blank to be blasted with particles, in particular glass particles, prior to the coating step in order for the surface to be cleaned so as to be as far as possible devoid of residues.

If residues are removed from the component blank, for example by ultrasound, following the coating step and the component blank is passivated, the result is a surface which produces a good bonding base for coatings, in particular primers or paints.

It is advantageous for the component blank to be conditioned following the coating step. It is particularly advantageous if the component blank is coated with a zinc-containing layer, since an oxide which is suitable as a bonding base is then formed at the surface.

A press-hardened component according to the invention, in particular a bodywork component, formed from a semi-finished product made from unhardened, hot-formable steel sheet, is produced by at least one of the refinements of the process according to the invention. A component of this type can particularly appropriately be produced in large numbers by suitable series production and combines an advantageous reduction in the weight of the component with an excellent resistance to corrosion.

BRIEF DESCRIPTION OF THE DRAWINGS

The present invention is explained in more detail below with reference to an exemplary embodiment illustrated in the drawing, in which.

DETAILED DESCRIPTION

FIGS. 1*a* to 1*f* diagrammatically depict a process according to the invention for producing a three-dimensionally shaped, press-hardened component 1 from a semi-finished product 2. In the present exemplary embodiment, the semi-finished product 2 used is a plate 3 which is cut out of an unwound coil 5. Alternatively, the semi-finished product 2 used may also be a composite metal sheet as described for example in DE 100 49 660 A1, comprising a base sheet and at least one reinforcing sheet. Furthermore, the semi-finished product 2 may also be a tailored blank, which comprises a plurality of welded-together metal sheets of different material thickness and/or different materials properties. Alternatively, the semi-finished product 2 may be a three-dimensionally shaped sheet-metal part which has been produced by any desired forming process and is to be further deformed and to have its strength and/or rigidity increased with the aid of the process according to the invention.

The semi-finished product 2 consists of an unhardened, hot-formable steel sheet. A particularly preferred material is a water-hardening heat-treated steel, as marketed for example by the German company Benteler AG under the trade name BTR 165. This steel includes the alloying constituents listed below, in which context the alloying constituents to be added in addition to the base metal iron are to be understood as being in percent by weight:

| | |
|---|---|
| Carbon | 0.23–0.27% |
| Silicon | 0.15–0.50% |
| Manganese | 1.10–1.40% |
| Chromium | 0.10–0.35% |
| Molybdenum | 0.00–0.35% |
| Titanium | 0.03–0.05% |
| Aluminum | 0.02–0.06% |
| Phosphorus | max. 0.025% |
| Sulfur | max. 0.01% |
| Total others | 0.0020–0.0035%. |

Figure 2A:
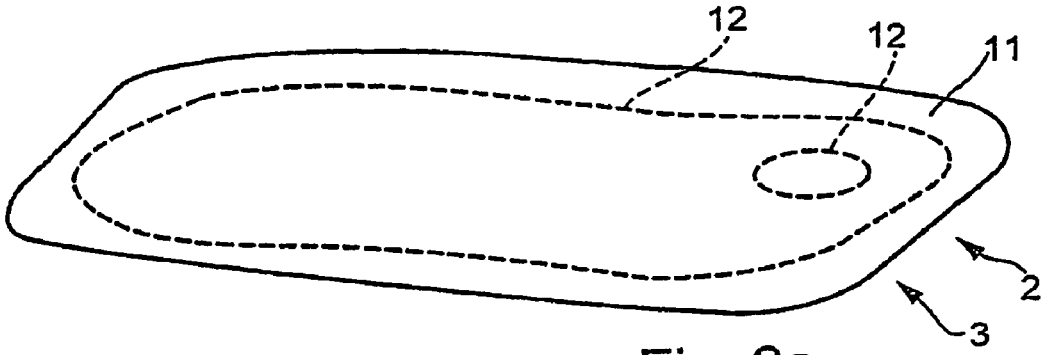
FIG. 2 shows perspective views of selected intermediate stages in the production of a component, including 2*a*: a semi-finished product; 2*b*: a component blank formed from it; 2*c*: a trimmed component blank; 2*d*: a coated component blank.

In a first process step I, the plate 3 (FIG. 1*a*) is cut out of an unwound and straightened section of a coil 5 formed from a hot-formable metal sheet. The hot-formable material is at this point in an unhardened state, so that plate 3 can be cut out without problems with the aid of conventional mechanical cutting means 4, for example cutting shears. When used in large-series production, it is advantageous for the plate blank 3 to be cut with the aid of a plate blanking press 6 which is responsible for automated supplying of the coil 5 and automated punching and removal of the cut plate 3. The plate 3 which has been cut out in this way is illustrated in diagrammatic perspective view in FIG. 2*a*.

Figure 1A:
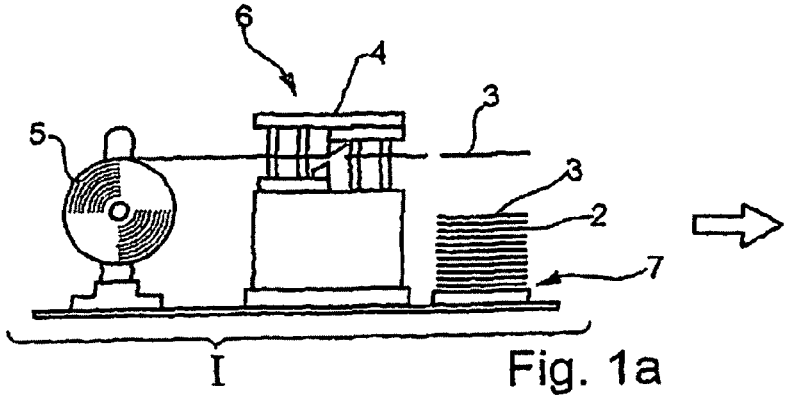
FIG. 1 shows a process sequence used to produce a press-hardened component, comprising 1*a*: cutting the plate blank (step I), 1*b*: cold-forming (step II); 1*c*: trimming the margins (step III); 1*d*: hot-forming (step IV); 1*e*: cleaning (step V); 1*f*: coating (step VI)
Figure 1B:
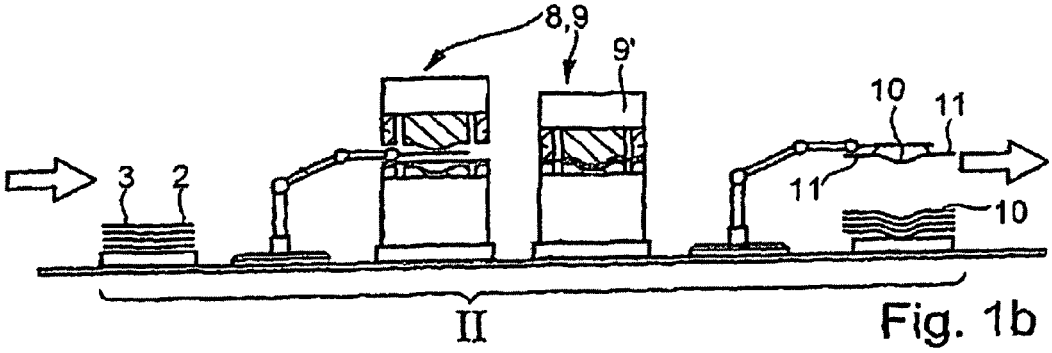
Figure 2B:
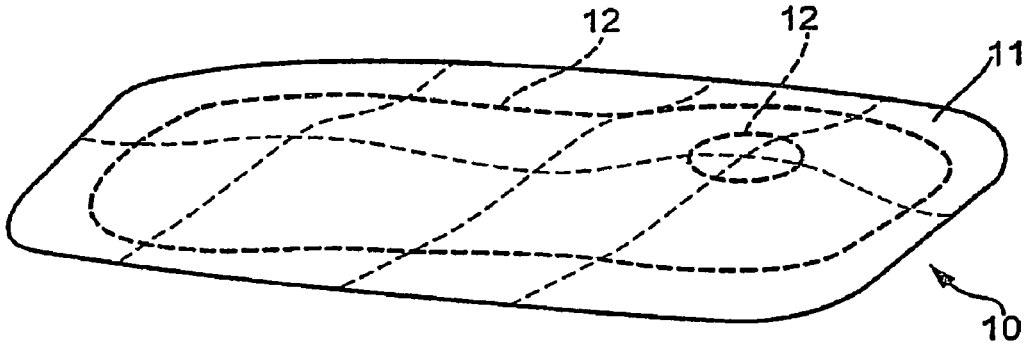

The plates 3 which have been cut out are put down on a stack 7 and fed in stacked form to a cold-forming station 8 (FIG. 1*b*). Here, a component blank 10 is formed from the plate 3 in a second process step II with the aid of the cold-forming tool 8, for example a two-stage deep-drawing tool 9. To be able to ensure high-quality forming of the component geometry, the plate 3 has margin regions 11 which project beyond an outer contour 12 of the component 1 that is to be formed. The component blank 10 is formed near net shape during this cold-forming process (process step II). In this context, the term "near net shape" is to be understood as meaning that those parts of the geometry of the finished component 1 which undergo a macroscopic flow of material have been formed into the component blank 10 after the cold-forming process has ended. Therefore, only minor shape modifications, requiring minimal (local) flow of material, are necessary to produce the three-dimensional shape of the component 1 after the cold-forming process has ended; the component blank 10 is illustrated in FIG. 2*b*.

Depending on the complexity of the component 1, the near net shape shaping may take place in a single deep-drawing step or in multiple stages (FIG. 1*b*). Following the cold-forming process, the component blank 10 is placed in a cutting apparatus 15, where it is trimmed (process step III, FIG. 1*c*). At this point, the material is still in the unhardened state, and therefore the trimming can be carried out with the aid of conventional mechanical cutting means 14, such as for example cutting blades, edge-removal and/or punching tools.

Figure 1C:
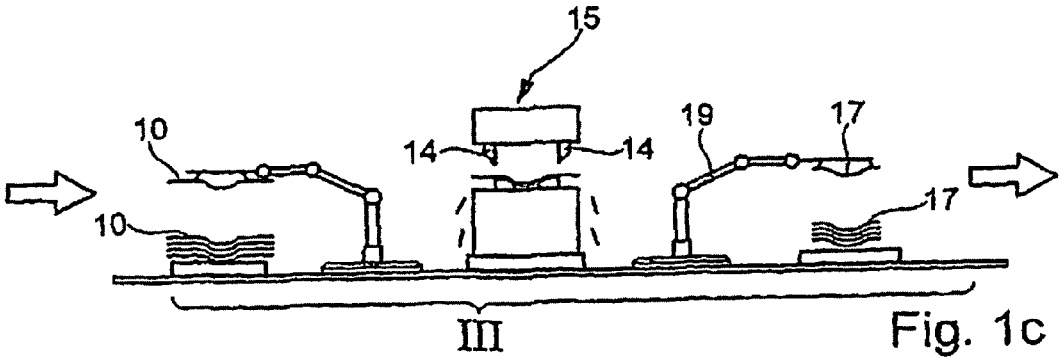
Figure 1D:
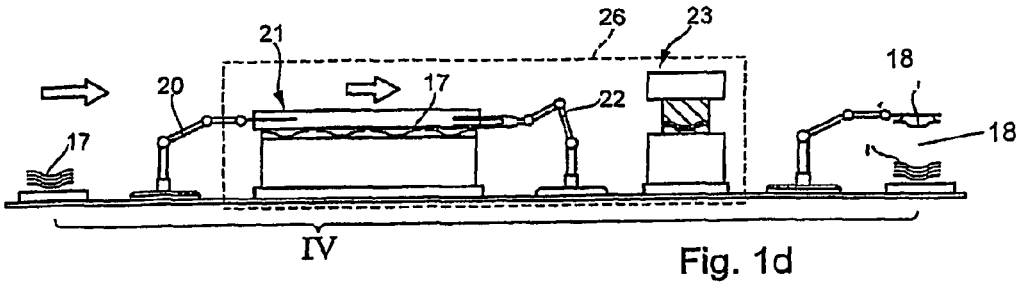

A separate cutting apparatus 15 can be used for the trimming, as shown in FIG. 1*c*. Alternatively, it is possible for the cutting means 14 to be integrated in the final stage 9' of the deep-drawing tool 9, so that in the final deep-drawing stage 9' the margin trimming takes place in addition to the final shaping of the sheet-metal blank 10.

Figure 2C:
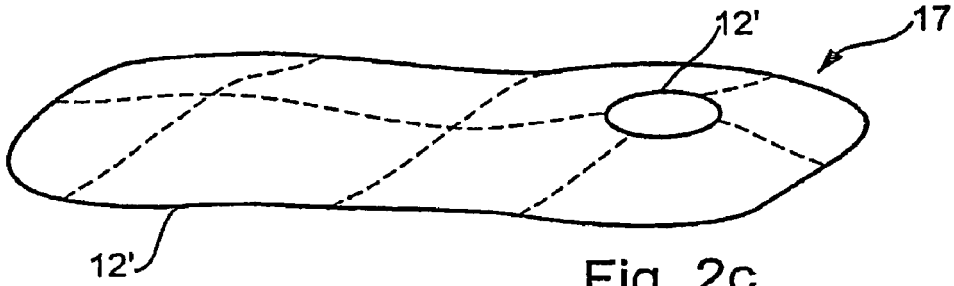
Figure 2D:
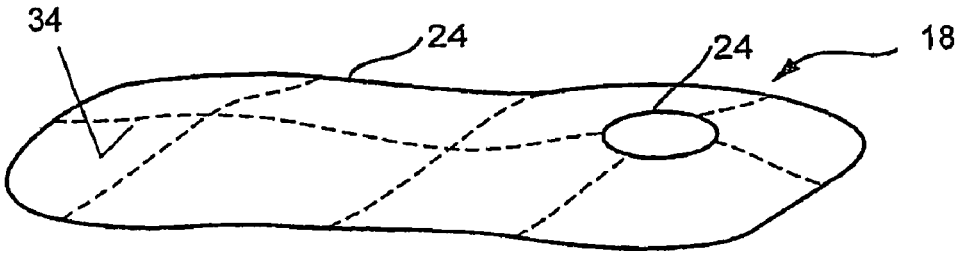

The cold-forming process and the trimming operation (process steps II and III) produce a component blank 17 which has been trimmed to near net shape from the plate 3; its three-dimensional shape and its marginal contour 12' deviate only slightly from the desired shape of the component 1. The margin regions 11 which have been cut off are discharged in the cutting apparatus 15; the component blank 17 (FIG. 2*c*) is removed from the cutting apparatus 15 with the aid of a manipulator 19 and then fed to the next process step IV.

In a particularly advantageous alternative, process steps II and III are integrated in a single processing station, in which the forming and cutting are carried out fully automatically. The component blank 17 can be removed automatically, or alternatively it is possible for the component blanks 17 to be removed and stacked manually.

In the following process step IV (FIG. 1*d*), the trimmed component blank 17 is subjected to hot-forming in a hot-forming region 26, during which it is formed into a final shape of the component 1 and hardened. The trimmed component blank 17 is placed by a manipulator 20 in a continuous furnace 21, where it is heated to a temperature that is above the microstructure transformation temperature to the austenitic state; depending on the grade of steel, this corresponds to heating to a temperature of between 700° C. and 1100° C. For a preferred material BTR 165, a favorable range is between 900° C. and 1000° C. The atmosphere of the continuous furnace is expediently inerted by the addition of a shielding gas, in order to prevent scaling of the uncoated cut parts of the marginal contour 12' of the trimmed component blanks 17 or, if uncoated plates 3 are being used, on the entire surface of the blank. Examples of suitable shielding gases include carbon dioxide and nitrogen.

The heated, trimmed component blank 17 is then placed, with the aid of a manipulator 22, in a hot-forming tool 23, in which the three-dimensional shape and the margin contour 12' of the trimmed component blank 17 are brought to their desired dimensions. Since the trimmed component blank 17 already has near net shape dimensions, only a minor alteration to the shape is required during the hot-forming. In the hot-forming tool 23, the trimmed component blank 17 is fully shaped and rapidly cooled, with the result that a fine-grained martensitic or bainitic material microstructure is established. This step corresponds to hardening of the component blank 18 and allows deliberate setting of the material strength. Details of a hardening process of this type are described for example in DE 100 49 660 A1. It is possible both to harden the entire component blank 17 and to carry out hardening on just a local basis at selected locations on the component blank 17. Once the desired degree of hardness of the component blank 18 has been reached, the hardened component blank 18 is taken out of the hot-forming tool 23 using a manipulator and if appropriate stacked until further processing. On account of the near net shape trimming of the component blank 10 preceding the hot-forming process and on account of the shape adjustment to the margin contour 12' in the hot-forming tool 23, the component 18 already has the desired external contour 24 of the finished component 1 once the hot-forming process is concluded, and consequently there is no need for time-consuming trimming of the component margin following the hot-forming.

To achieve rapid quenching of the component blank 18 during the hot-forming, the component blank 18 can be quenched in a cooled hot-forming tool 23. When using uncoated plates 3, the hot-forming of the component blank 18 is usually associated with scaling of the surface, and consequently the surface then has to be cleaned.

Since there is no need for laser-cutting of the hardened component blank 18, the cycle times in the manufacturing process are advantageously short. The cooling of the component blank 18 is presently a bottleneck in the process sequence according to the invention. To alleviate this problem, it is possible to use air-hardening or water-hardening materials for the components 1. The component blank 18 only needs to be cooled until a sufficient hot strength, rigidity and associated dimensional stability of the component blank 18 have been achieved. Then, the component blank 18 can be removed from the tool 23, so that the further heat treatment operation takes place in air or water outside the tool 23, which is then very quickly available again to receive further component blanks 17 after just a few seconds.

Figure 1E:
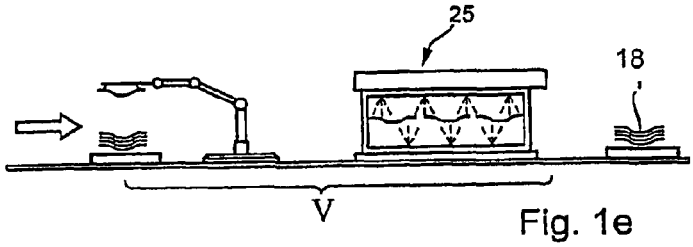
Figure 1F:
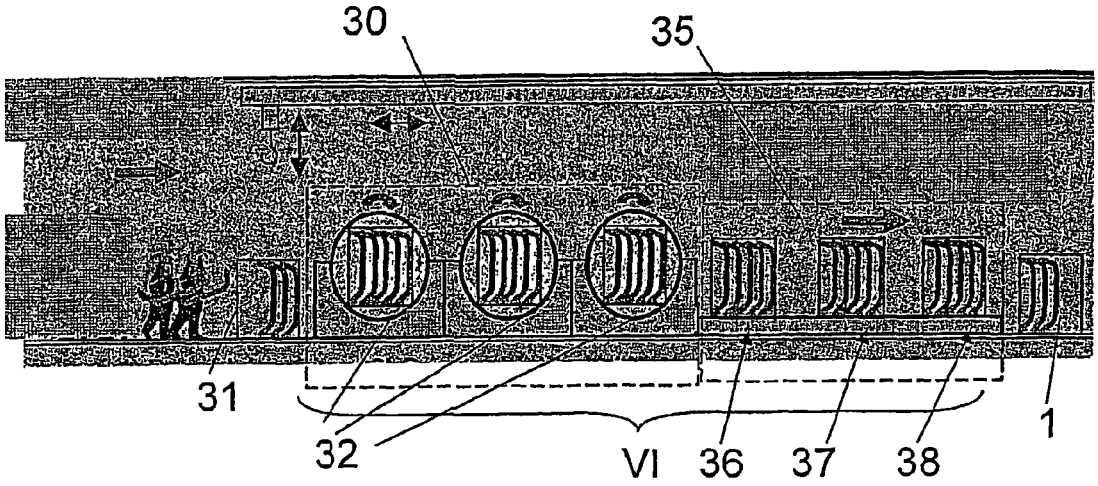

In further process steps V and VI (FIG. 1*e*, FIG. 10, the press-hardened component blank 18 is first of all subjected to dry cleaning in a dry-cleaning installation 25 and then covered with a layer 34 which prevents corrosion of the component 1 in a coating process. For this purpose, a plurality of press-hardened component blanks 18, preferably suspended in parallel or lying in series, are introduced into the dry-cleaning installation 25 and, for example, blasted by shot-peening units. The surface of the component blanks 18 is then substantially oxide-free. Next, drums 31 are fed with the cleaned and press-hardened component blanks 18 and a zinc-containing powder, preferably a zinc alloy or a zinc-containing mixture, closed and introduced into a coating installation 30, where the component blanks 18 are heated slowly, at approx. 5-10° C./min, to approximately 300° C. with the drums 31 rotating slowly. During this thermal diffusion process, the zinc or zinc alloy is distributed substantially homogeneously over the entire surface of the component blanks 18 and bonds to the surface.

An even layer thickness, which can be set as desired between a few μm and over 100 μm, preferably between 5 μm and 120 μm, is established on the component blanks 18 as a function of the composition of the powder, the time and the temperature. The layer 34 is weldable and produces a tensile strength which may be more than 1300 MPa for a component 1 made from BTR 165. There are scarcely any residues or emissions into the environment produced during the thermal diffusion process.

The coating process is concluded with a passivation operation in an adjoining passivation station 35, in which the drums 31 are discharged from the coating installation 30, cooled in a cooling station 36, have residues of the coating powder removed from them using ultrasound in a cleaning station 37 and are conditioned in a conditioning station 38 at a temperature of approximately 200° C. for approximately 1 h, during which step the layer 34 is passivated. If appropriate, it is also possible to add suitable passivation additives. Then, the finished corrosion-protected components 1 can be removed from the drum 31.

In an alternative configuration, the zinc-containing layer 34 can be applied to the press-hardened component blank 18 using a hot-dip galvanization process, in which the component blanks 18 are dipped in a bath comprising a zinc-containing liquid.

Figure 3B:
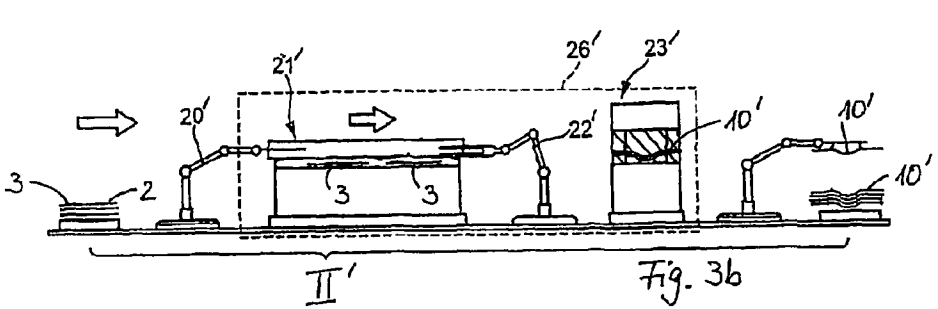
FIG. 3 shows an alternative process sequence used to produce a press-hardened component, comprising 3*a*: cutting the plate blank (step I); 3*b*: hot-forming (step II'); 3*c*: trimming the margins (step III'); 3*d*: cleaning (step IV); 3*e*: coating (step V).
Figure 3D:
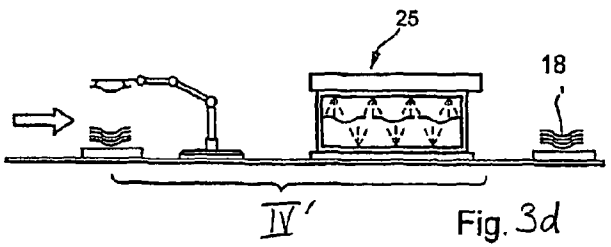
Figure 3A:
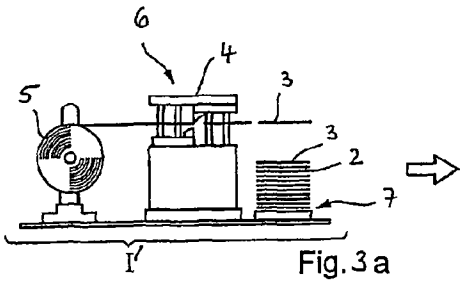
Figure 3C:
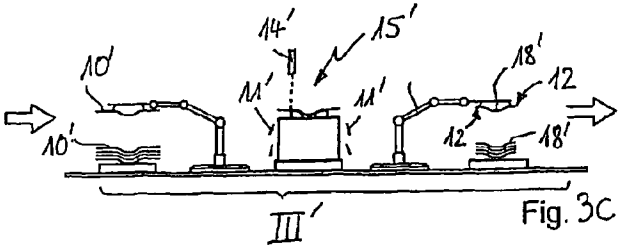
Figure 3E:
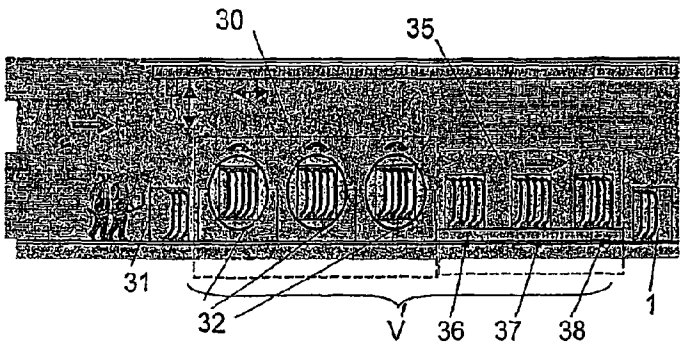

FIGS. 3*a* to 3*e* diagrammatically depict an alternative process sequence for the production of a three-dimensionally shaped, press-hardened component 1 from a semi-finished product 2, in particular from a plate 3. In a first process step (FIG. 3*a*), the plate 3 is cut from an unwound and straightened section of a sheet-metal coil 5 in the plate press 6 and placed on a stack 7. Then, the plate 3 is subjected to a hot-forming step (FIG. 3*b*). For this purpose, a manipulator 20' places the plate 3 in a continuous furnace 21', in which the plate 3 is heated to a temperature which is above the transition temperature to the austenitic microstructure state. Then, the heated plate 3 is placed in a hot-forming tool 23', in which a component blank 10' of the desired three-dimensional shape is formed from the plate 3; in the process, the component blank 10' is cooled sufficiently quickly for it to undergo (component-wide or local) hardening. The continuous furnace 21' and the hot-forming tool 23' are advantageously in a shielding gas atmosphere 26' in order to suppress scaling of the plates 3.

Then, the hardened component blank 10' is transferred to a cutting apparatus 15' (FIG. 3*c*), in which the component blank 10' is trimmed at the margin in order to produce a blank 18' with margin contour 12. The trimming is preferably carried out using a laser 14'. The margin regions 11' which have been cut off are disposed of. In the subsequent process steps shown in FIGS. 3*d* and 3*e*, the press-hardened and trimmed blank 18' is subjected to dry cleaning and coated in a coating installation 30 in the same way as in process stages V and VI illustrated in FIGS. 1*e* and 1*f*.

The press-hardened, coated component 1 is particularly suitable as a bodywork component in the automotive industry, which is produced in large numbers. The process according to the invention allows advantageous process management with short cycle times, and all the process steps are potentially suitable for industrialization. Unlike when using materials which have been pre-coated with a corrosion-prevention coating, such as for example Usibor 1500 PC, it is possible to use conventional pre-forming. The subsequent application of a corrosion-prevention coating allows conventional forming and trimming even when using high-strength materials, which means that the laser cutting operation, which is complex when using large numbers, can be inexpensively replaced. This manufacturing method allows the production viability of sheet-metal components to be validated as early as in the development stage by conventional forming simulation. An additional benefit is the protection against corrosion, in particular when using zinc layers, with the advantage of edge coating. Furthermore, in a vehicle assembled from such components, the fuel consumption is reduced on account of the drop in weight of the components, since these components can be made significantly thinner than conventional sheet-metal parts, while at the same time the passive safety is increased, since the components have a very high strength.

What is claimed is:

1. A process for producing a press-hardened component from a semi-finished product made of unhardened, hot-formable steel sheet, the process comprising:

forming a component blank from the steel semi-finished product using a cold-forming process, the component blank including a margin contour corresponding approximately to a contour of the press-hardened component and a margin edge;

trimming the component blank at the margin edge to the margin contour;

heating and press-hardening the trimmed component blank using a hot-forming tool; adjusting the shape of the margin contour in the hot-forming tool; and covering the press-hardened component blank with a corrosion-prevention layer in a coating step, wherein the coating step includes a thermal diffusion process.

2. The process as recited in claim 1, wherein the press-hardened component is a bodywork component.

3. The process as recited in claim 1, wherein the cold-forming process includes a drawing process.

4. The process as recited in claim 1, further comprising cleaning the press-hardened component blank by dry cleaning prior to the coating step.

5. The process as recited in claim 1, further comprising blasting the press-hardened component blank with particles prior to the coating step.

6. The process as recited in claim 5, wherein the particles include glass particles.

7. The process as recited in claim 1, further comprising removing residues from the coating step from the coated component blank after the coating step.

8. The process as recited in claim 1, further comprising conditioning the coated component blank after the coating step.

9. The process as recited in claim 1 wherein the thermal diffusion process including heating the component at 5 to 10° C./min.

10. The process as recited in claim 1 wherein the thermal diffusion process includes heating the component solely to approximately 300 degrees Celcius.

11. The process as recited in claim 1 wherein the thermal diffusion process includes the steps of:

placing the press-hardened, trimmed component blank, a plurality of other press-hardened, trimmed component blanks and a zinc-containing powder into a drum and closing the drum;

introducing the drum to a coating installation; and heating the drum at approximately 5 to 10° C./min to approximately 300 degrees Celsius and rotating the drum during the heating.

12. The process as recited in claim 11 wherein after the step of heating the drum, the thermal diffusion process includes the step discharging the drum from the coating installation and cooling the drum in a cooling station.

13. A process for producing a press-hardened component from a semi-finished product made of unhardened, hot-formable steel sheet, the process comprising:

heating and press-hardening the semi-finished steel product using a hot-forming tool so as to form a press-hardened component blank, having a margin contour corresponding approximately to the press-hardened component and a margin edge;

adjusting the shape of the margin contour in the hot-forming tool;

trimming the press-hardened component blank at the margin edge to the margin contour;

covering the press-hardened, trimmed component blank with a corrosion-prevention layer in a coating step, wherein the coating step includes a thermal diffusion process.

14. The process as recited in claim 13, wherein the press-hardened component is a bodywork component.

15. The process as recited in claim 11, further comprising cleaning the press-hardened component blank by dry cleaning prior to the coating step.

16. The process as recited in claim 13, further comprising blasting the press-hardened component blank with particles prior to the coating step.

17. The process as recited in claim 16, wherein the particles include glass particles.

18. The process as recited in claim 13, further comprising removing residues from the coating step from the coated component blank after the coating step.

19. The process as recited in claim 13, further comprising conditioning the coated component blank after the coating step.

20. The process as recited in claim 13 wherein the thermal diffusion process including heating the component at 5 to 10° C./min.

21. The process as recited in claim 13 wherein the thermal diffusion process includes heating the component solely to approximately 300 degrees Celcius.

22. The process as recited in claim 13 wherein the thermal diffusion process includes the steps of:

placing the press-hardened, trimmed component blank, a plurality of other press-hardened, trimmed component blanks and a zinc-containing powder into a drum and closing the drum;

introducing the drum to a coating installation; and heating the drum at approximately 5 to 10° C./min to approximately 300 degrees Celsius and rotating the drum during the heating.

23. The process as recited in claim 22 wherein after the step of heating the drum, the thermal diffusion process includes the step discharging the drum from the coating installation and cooling the drum in a cooling station.

* * * * *